US010403190B2

(12) United States Patent
Han et al.

(10) Patent No.: US 10,403,190 B2
(45) Date of Patent: Sep. 3, 2019

(54) METHOD FOR COLOR COMPLEMENTATION ON WOLED DISPLAY DEVICE, AND DISPLAY DEVICE

(71) Applicant: BOE TECHNOLOGY GROUP CO., LTD., Beijing (CN)

(72) Inventors: Dongxu Han, Beijing (CN); Fei Yang, Beijing (CN); Zhongyuan Wu, Beijing (CN); Yongqian Li, Beijing (CN); Tieshi Wang, Beijing (CN); Zhidong Yuan, Beijing (CN); Can Yuan, Beijing (CN); Chi Zhang, Beijing (CN); Yue Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/975,742

(22) Filed: May 9, 2018

(65) Prior Publication Data

US 2019/0027081 A1 Jan. 24, 2019

(30) Foreign Application Priority Data

Jul. 19, 2017 (CN) ..... 2017 1 0589834

(51) Int. Cl.
*G09G 3/30* (2006.01)
*G09G 3/20* (2006.01)
(Continued)

(52) U.S. Cl.
CPC ..... *G09G 3/2003* (2013.01); *G09G 3/006* (2013.01); *G09G 3/3208* (2013.01); *G09G 5/10* (2013.01);
(Continued)

(58) Field of Classification Search
CPC ..... G09G 3/12–14; G09G 3/30–3291
See application file for complete search history.

(56) References Cited

U.S. PATENT DOCUMENTS

2009/0295839 A1* 12/2009 Furukawa ..... G09G 3/3413 345/690
2016/0035293 A1* 2/2016 Furihata ..... G09G 3/36 345/694
2017/0345390 A1* 11/2017 Orio ..... G09G 5/02

* cited by examiner

*Primary Examiner* — Sanghyuk Park
(74) *Attorney, Agent, or Firm* — Kinney & Lange, P.A.

(57) ABSTRACT

Disclosed are a method for color complementation on a white organic light emitting diode (WOLED) display device, and a display device. The method comprises: (a) acquiring respective first chromaticity coordinates of each of red (R), green (G), blue (B), and white (W) sub-pixel units for a brightness outputted by the WOLED display device; (b) calculating a first complementary color ratio among the R, G, B, and W sub-pixel units; (c) determining a desired brightness of the W sub-pixel unit, and obtaining respective first complementary color brightnesses of each of the R, G, B, and W sub-pixel units, and in turn determining respective second chromaticity coordinates of each of the R, G, B, and W sub-pixel units corresponding to the respective first complementary color brightness of each of the R, G, B, W sub-pixel units; and (d) implementing in iterations steps (a), (b) and (c), so as to obtain a second complementary color ratio among the R, G, B, W sub-pixel units corresponding to the desired brightness of the W sub-pixel unit. Color complementation of the WOLED display device is carried out depending on the second complementary color ratio among the R, G, B, and W sub-pixel units when the brightness outputted by the WOLED display device reaches the desired brightness of W sub-pixel unit.

18 Claims, 2 Drawing Sheets

(51) Int. Cl.

| | |
|---|---|
| ***G09G 3/3208*** | (2016.01) |
| ***G09G 5/10*** | (2006.01) |
| ***G09G 3/00*** | (2006.01) |

(52) U.S. Cl.

CPC ..... *G09G 2300/0452* (2013.01); *G09G 2320/0242* (2013.01); *G09G 2320/0626* (2013.01); *G09G 2320/0666* (2013.01); *G09G 2360/16* (2013.01)

METHOD FOR COLOR COMPLEMENTATION ON WOLED DISPLAY DEVICE, AND DISPLAY DEVICE

CROSS-REFERENCE TO RELATED APPLICATION

The present application claims the benefit of Chinese Patent Application No. 201710589834.4 filed on Jul. 19, 2017 in the State Intellectual Property Office of China, the whole disclosure of which is incorporated herein by reference.

BACKGROUND

Technical Field

Embodiments of the present disclosure relate to the technical field of display, and especially to a method for a color complementation on a white organic light emitting diode (WOLED) display device, and a display device.

Description of the Related Art

A WOLED display device comprises a plurality of pixel units, each of which further comprises a red sub-pixel unit (i.e., R sub-pixel unit), a green sub-pixel unit (i.e., G sub-pixel unit), a blue sub-pixel unit (i.e., B sub-pixel unit), and a white sub-pixel unit (i.e., W sub-pixel unit) collectively. A white color may be displayed by a combination of above sub-pixel units, in practical use. Typically, there may be a deviation between a practical chromaticity coordinate of a white light emitted by the WOLED display device and a desired chromaticity coordinate of white light, such that in the WOLED display device, some of the R, G, B sub-pixel units and the W sub-pixel unit in each pixel unit should be used to cooperate with one another collectively to display white so as to compensate for the chromaticity coordinate of white color, i.e., to implement a color complementation on the WOLED display device.

A method for the color complementation of the WOLED display device in the relevant art may be implemented by measuring respective chromaticity coordinates of the R, G, B, W sub-pixel units in each one of the plurality of pixel units within an active area (AA) across a panel of the whole WOLED display device, and the respective chromaticity coordinates of the R, G, B, W sub-pixel units essentially refer to R chromaticity coordinate, G chromaticity coordinate, B chromaticity coordinate, and W chromaticity coordinate, respectively, i.e., respective chromaticity coordinates of the four sub-pixel units in each pixel unit; it is apparent that same or similar expressions as set forth hereinafter are all representative of such a meaning. Based on color-mixing equations in colorimetry, a complementary color ratio among the R, G, B, W sub-pixel units in each pixel unit may be calculated.

Then, a desired brightness of W sub-pixel unit may further be determined (the desired brightness of W sub-pixel unit is defined as a brightness outputted by any W sub-pixel unit which brightness has a value considered to be already determined and achievable by the display device; and it should be noticed that said 'desired brightness of W sub-pixel unit' as set forth hereinafter may all be representative of such a meaning). Next, the desired brightness of W sub-pixel unit is multiplied by a complementary color ratio among the R, G, B, W sub-pixel units so as to obtain respective complementary color brightnesses of the R, G, B, W sub-pixel units, such that the color complementation of the WOLED display device is implemented. It should be noticed that, in above relevant method, when respective complementary color brightnesses of the R, G, B, W sub-pixel units are being determined, respective chromaticity coordinates of the four sub-pixel units R, G, B, W are essentially not chromaticity coordinates which are displayed in practice.

SUMMARY

The embodiments of the present disclosure have been made to overcome or alleviate at least one aspect of the above mentioned disadvantages and/or shortcomings in the prior art, by providing a method for a color complementation on a WOLED display device, and a display device.

Following technical solutions are adopted in exemplary embodiments of the disclosure for achieving the above desired technical purposes.

According to an aspect of the exemplary embodiment of the present disclosure, there is provided method for color complementation on a WOLED display device, comprising:

(a) acquiring respective first chromaticity coordinates of each of R, G, B, and W sub-pixel units for a brightness outputted by the WOLED display device;

(b) calculating a first complementary color ratio among the R, G, B, and W sub-pixel units depending on the respective first chromaticity coordinate of each of the R, G, B, and W sub-pixel units;

(c) determining a desired brightness of the W sub-pixel unit, and obtaining respective first complementary color brightnesses of each of the R, G, B, and W sub-pixel units by multiplying the desired brightness of the W sub-pixel unit by the first complementary color ratio among the R, G, B, and W sub-pixel units, and in turn determining respective second chromaticity coordinates of each of the R, G, B, and W sub-pixel units corresponding to the respective first complementary color brightnesses of each of the R, G, B, and W sub-pixel units; and (d) implementing in iterations steps (a), (b) and (c) at least once, so as to obtain a second complementary color ratio among the R, G, B, and W sub-pixel units corresponding to the desired brightness of W sub-pixel unit;

wherein a complementary color ratio is defined as a ratio among proportion values each of which is calculated by dividing respective desired brightness variations of each of the R, G, B, and W sub-pixel units to achieve by the desired brightness of white light respectively, i.e., as a ratio among a respective desired variance ratio of brightness of each single sub-pixel unit in a pixel; and during each iteration of steps (a), (b) and (c), the respective second chromaticity coordinates of each of the R, G, B, and W sub-pixel units acquired in a most recent iteration is used alternatively to function as the respective first chromaticity coordinate of each of the R, G, B, and W sub-pixel units in a current iteration, and the second complementary color ratio among the R, G, B, and W sub-pixel units is defined as the first complementary color ratio among the R, G, B, W sub-pixel units acquired in a most recent iteration; and a color complementation step is carried out, i.e., implementing the color complementation of the WOLED display device depending on the second complementary color ratio among the R, G, B, and W sub-pixel units when the brightness outputted by the WOLED display device reaches the desired brightness of W sub-pixel unit.

In an embodiment of the disclosure, implementing the color complementation of the WOLED display device depending on the second complementary color ratio among the R, G, B, W sub-pixel units when the brightness outputted by the WOLED display device reaches the desired brightness of W sub-pixel unit comprises:

obtaining respective second complementary color brightnesses of each of the R, G, B, W sub-pixel units by multiplying the desired brightness of the W sub-pixel unit by the second complementary color ratio among the R, G, B, W sub-pixel units when the brightness outputted by the WOLED display device reaches the desired brightness of W sub-pixel unit; and adjusting respective brightnesses practically outputted by the R, G, B, W sub-pixel units to respective second complementary color brightnesses of the R, G, B, W sub-pixel units.

In an embodiment of the disclosure, following implementing in iterations steps (a), (b) and (c) at least once, so as to obtain the second complementary color ratio among the R, G, B, W sub-pixel units corresponding to the desired brightness of the W sub-pixel unit, the method further comprises:

obtaining a plurality of second complementary color ratios among the R, G, B, W sub-pixel units in one-to-one correspondence with a plurality of different desired brightnesses of the W sub-pixel unit respectively;

generating a set of successive association relations between the brightness outputted by the WOLED display device and a third complementary color ratio among the R, G, B, W sub-pixel units by interpolation, based on the plurality of second complementary color ratios among the R, G, B, W sub-pixel units in one-to-one correspondence with the plurality of different desired brightnesses of W sub-pixel unit respectively; and implementing the color complementation of the WOLED display device depending on the set of successive association relations.

In an embodiment of the disclosure, implementing the color complementation of the WOLED display device depending on the set of successive association relations comprises:

determining the third complementary color ratio among the R, G, B, W sub-pixel units corresponding to the brightness outputted by the WOLED display device, depending on the set of successive association relations, and obtaining respective third complementary color brightnesses of each of the R, G, B, W sub-pixel units by multiplying the brightness outputted by the WOLED display device by the third complementary color ratio among the R, G, B, W sub-pixel units; and adjusting respective brightnesses practically outputted by the R, G, B, W sub-pixel units to respective third complementary color brightnesses of the R, G, B, W sub-pixel units.

In an embodiment of the disclosure, obtaining a plurality of second complementary color ratios among the R, G, B, W sub-pixel units in one-to-one correspondence with a plurality of different desired brightnesses of W sub-pixel unit respectively comprises:

obtaining a plurality of different desired brightnesses of W sub-pixel unit at an interval to function as the plurality of desired brightnesses of W sub-pixel unit.

In an embodiment of the disclosure, the interval ranges between 1 nit and 10 nits.

In an embodiment of the disclosure, the interval is 5 nits.

In an embodiment of the disclosure, acquiring respective first chromaticity coordinates of each of R, G, B, W sub-pixel units for a brightness outputted by the WOLED display device comprises:

increasing the brightness outputted by the WOLED display device persistently;

and recording respective chromaticity coordinates of each of the R, G, B, W sub-pixel units as the respective first chromaticity coordinates of each of the R, G, B, W sub-pixel units, once the respective chromaticity coordinate of each of the R, G, B, W sub-pixel units stop changing with the increase in the brightness outputted by the WOLED display device.

According to another aspect of the exemplary embodiment of the present disclosure, there is provided a display device which implements the color complementation by applying the method as above, the display device comprising:

a display panel comprising a plurality of pixels, each of which comprises a R sub-pixel unit, a G sub-pixel unit, a B sub-pixel unit, and a W sub-pixel unit; and a driving circuit, the driving circuit configured to implement the color complementation of the WOLED display device depending on the second complementary color ratio among the R, G, B, W sub-pixel units in a condition that the brightness outputted by the WOLED display device reaches the desired brightness of W sub-pixel unit.

In an embodiment of the disclosure, the driving circuit is further configured to implement the color complementation of the WOLED display device depending on the association relations.

BRIEF DESCRIPTION OF THE DRAWINGS

The above and other features and advantages of the present disclosure will become more apparent and a more comprehensive understanding of the present disclosure can be obtained, by describing in detail exemplary embodiments thereof with reference to the accompanying drawings, in which.

DETAILED DESCRIPTION

Figure 1:
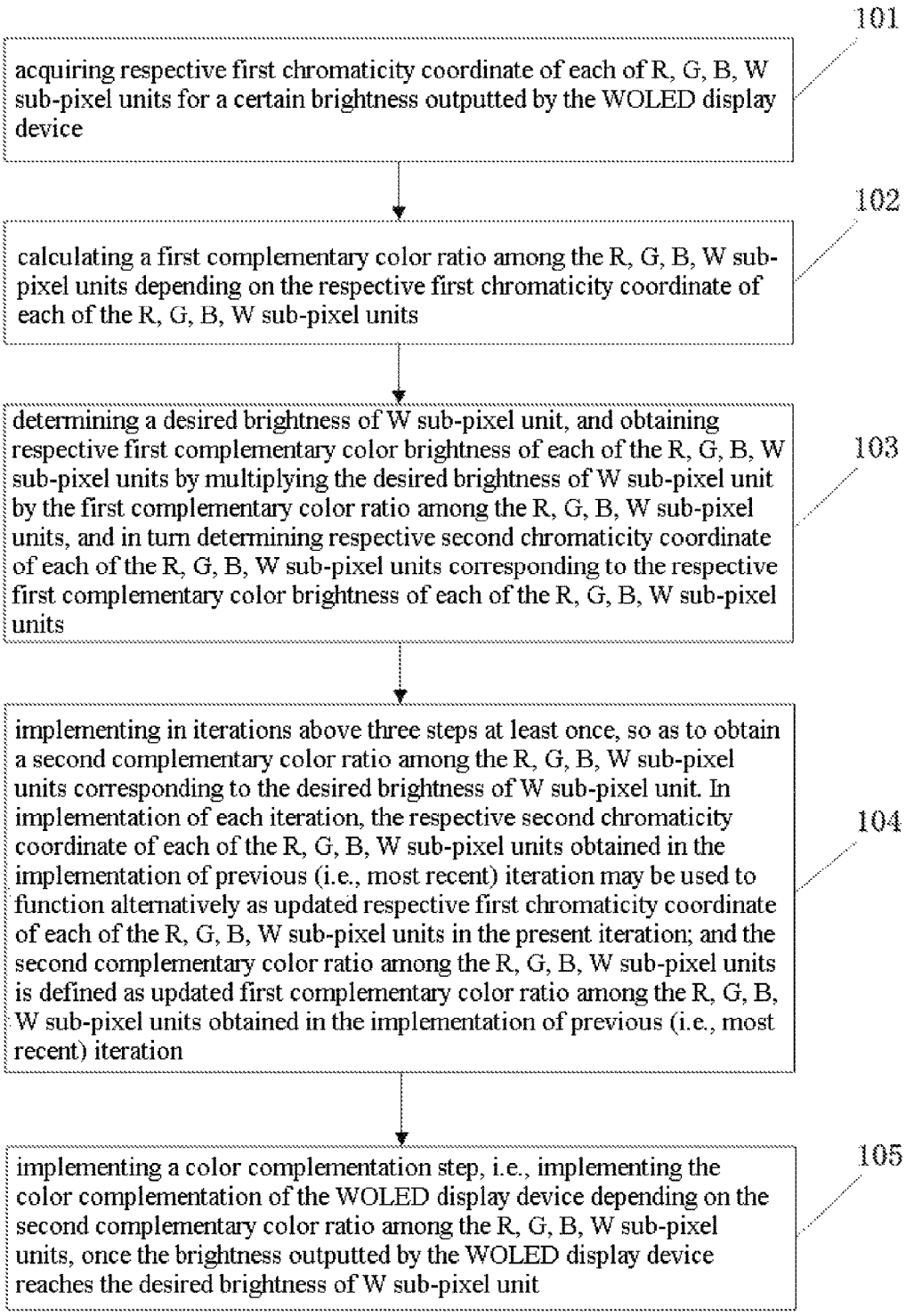
FIG. 1 illustrates a flow chart of a method for a color complementation on a WOLED display device according to an exemplary embodiment of the disclosure.

Exemplary embodiments of the present disclosure will be described hereinafter in detail with reference to the attached drawings, wherein the like reference numerals refer to the like elements. The present disclosure may, however, be embodied in many different forms, and thus the detailed description of the embodiment of the disclosure in view of attached drawings should not be construed as being limited to the embodiment set forth herein; rather, these embodiments are provided so that the present disclosure will be thorough and complete, and will fully convey the general concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to a general technical concept of embodiments of the present disclosure, as illustrated in FIG. 1, there is provided a method for a color complementation on a WOLED display device. Referring to FIG. 1, FIG. 1 illustrates a flow chart of a method for a color complementation on a WOLED display device according to an exemplary embodiment of the disclosure.

The method for a color complementation on a WOLED display device comprises following steps:

Step 101: acquiring respective first chromaticity coordinate of each of R, G, B, W sub-pixel units for a certain brightness outputted by the WOLED display device.

In this step, the WOLED display device is powered on, i.e., energized for implementing a normal display process, in which the WOLED display device is adjusted to the certain brightness outputted thereby, and then respective brightness outputted by the R, G, B, W sub-pixel units at that time is recorded to function as the respective first chromaticity coordinate of each of the R, G, B, W sub-pixel units. Therefore, it may be seen that, the respective first chromaticity coordinate of each of the R, G, B, W sub-pixel units is defined as respective brightness outputted by the R, G, B, W sub-pixel units as recorded in practical measurement.

In a further embodiment of the disclosure, in the process of acquiring the respective first chromaticity coordinate of each of the R, G, B, W sub-pixel units, specific implementations are carried out as below: powering on the WOLED display device for implementing the normal display process, and increasing persistently respective brightness practically outputted by the WOLED display device. In such a process, as the brightness outputted by the WOLED display device increases persistently, the chromaticity coordinate of each of the R, G, B, W sub-pixel units is changed significantly therewith (i.e., corresponding thereto). Due to specific manufacturing processes of the WOLED display device, once the brightness outputted by the WOLED display device increases to a certain value, the respective brightness outputted by each of the R, G, B, W sub-pixel units may not change or may not change significantly as the brightness outputted by the WOLED display device increases; and the respective chromaticity coordinate of each of the R, G, B, W sub-pixel units on that occasion is essentially brought more closer to practical respective chromaticity coordinate of each of the R, G, B, W sub-pixel units at work, and therefore the chromaticity coordinate of each of the R, G, B, W sub-pixel units on that occasion is recorded as the respective first chromaticity coordinate of each of the R, G, B, W sub-pixel units, which may further enhance accuracy of the method for the color complementation according to embodiments of the disclosure.

Step 102: calculating a first complementary color ratio among the R, G, B, W sub-pixel units depending on the respective first chromaticity coordinate of each of the R, G, B, W sub-pixel units.

In this step, based on the respective first chromaticity coordinate of each of the R, G, B, W sub-pixel units acquired in above step, the first complementary color ratio among the R, G, B, W sub-pixel units is obtained by calculation based on the color-mixing equations in colorimetry. By way of example, in a condition that each pixel is required to emit a white light in per light intensity unit (e.g., with a value of 1), then a complementary color ratio is defined as a ratio among proportion values each of which is calculated by dividing respective desired brightness variation of each of the four sub-pixel units (i.e., R, G, B, W sub-pixel units in each pixel) to achieve by the desired brightness of white light (i.e., light intensity unit being equal to 1) respectively, i.e., as a ratio among a respective desired variance ratio of brightness of each single sub-pixel unit in a pixel. By way of example, only intending for exemplification rather than applying any limitation, provided that the desired W brightness is for example $L_W=1$, and e.g., in a condition that a pixel exhibits a color shift towards green (i.e., the pixel shows a greenish color), then the color complementation process may typically be concluded to be: preserving the brightness of the G sub-pixel unit to be unchanged, and adjusting both the brightness of the R sub-pixel unit and the brightness of the B sub-pixel unit simultaneously. For example, the R sub-pixel unit is required to increase its brightness by $\Delta L_R$, the B sub-pixel unit is required to increase its brightness by $\Delta L_B$, and the G sub-pixel unit is required to increase its brightness by $\Delta L_G=0$, then, in order to preserve an overall brightness of the single pixel (in which these sub-pixel units are located) to be unchanged during the color complementation process, then the W sub-pixel unit is required to change its brightness accordingly by $\Delta L_W=L_W-\Delta L_R-\Delta L_B-\Delta L_G=1-\Delta L_R-\Delta L_B$. Then in such a condition, the complementary color ratio among the R, G, B, W sub-pixel units in each pixel unit may correspondingly be represented as below, i.e., $$\frac{\Delta L_R}{L_W}:\frac{\Delta L_G}{L_W}:\frac{\Delta L_B}{L_W}:\left(1-\frac{\Delta L_R}{L_W}-\frac{\Delta L_G}{L_W}-\frac{\Delta L_B}{L_W}\right)=$$
$$\frac{\Delta L_R}{L_W}:\frac{0}{L_W}:\frac{\Delta L_B}{L_W}:\left(1-\frac{\Delta L_R}{L_W}-\frac{0}{L_W}-\frac{\Delta L_B}{L_W}\right)=$$
$$\frac{\Delta L_R}{L_W}:0:\frac{\Delta L_B}{L_W}:\left(1-\frac{\Delta L_R}{L_W}-\frac{\Delta L_B}{L_W}\right)$$

and the process of calculating the first complementary color ratio among the R, G, B, W sub-pixel units in such a step is already a known relevant technology, whose specific calculation processes, principles and equations will not be set forth herein in detail.

Step 103: determining a desired brightness of W sub-pixel unit, and obtaining respective first complementary color brightness of each of the R, G, B, W sub-pixel units by multiplying the desired brightness of W sub-pixel unit by the first complementary color ratio among the R, G, B, W sub-pixel units, and in turn determining respective second chromaticity coordinate of each of the R, G, B, W sub-pixel units corresponding to the respective first complementary color brightness of each of the R, G, B, W sub-pixel units In this step, the desired brightness of W sub-pixel unit is determined above all, and then the desired brightness of W sub-pixel unit is multiplied by the first complementary color ratio among the R, G, B, W sub-pixel units so as to obtain the respective first complementary color brightness of the R, G, B, W sub-pixel units. The steps of the method as above are identical to corresponding steps in relevant art, and the respective first complementary color brightness of each of the R, G, B, W sub-pixel units as obtained on this occasion may only be used to acquire respective second chromaticity coordinate of each of the R, G, B, W sub-pixel units corresponding to the respective first complementary color brightness of each of the R, G, B, W sub-pixel units, rather than being used for practical color complementation. Therefore it may be seen that, the respective second chromaticity coordinate of each of the R, G, B, W sub-pixel units may be defined as respective chromaticity coordinate of each of the R, G, B, W sub-pixel units corresponding to the respective first complementary color brightness of each of the R, G, B, W sub-pixel units as obtained by above calculation, which respective chromaticity coordinate differs from the respective first chromaticity coordinate of each of the R, G, B, W sub-pixel units which functions as actual data measured in practice.

Step 104: implementing in iterations above three steps at least once, so as to obtain a second complementary color ratio among the R, G, B, W sub-pixel units corresponding to the desired brightness of W sub-pixel unit. In implementation of each iteration, the respective second chromaticity coordinate of each of the R, G, B, W sub-pixel units obtained in the implementation of previous (i.e., most recent) iteration may be used to function alternatively as updated respective first chromaticity coordinate of each of the R, G, B, W sub-pixel units in the present iteration; and the second complementary color ratio among the R, G, B, W sub-pixel units is defined as updated first complementary color ratio among the R, G, B, W sub-pixel units obtained in the implementation of previous (i.e., most recent) iteration.

In this step, above steps 101 to 103 are carried out iteratively. To be specific, in the implementation of each iteration, in implementation of each iteration, the respective second chromaticity coordinate of each of the R, G, B, W sub-pixel units obtained in the implementation of previous (i.e., most recent) iteration may be used to function alternatively as updated respective first chromaticity coordinate of each of the R, G, B, W sub-pixel units in the present iteration, so as to implement a calculation in a subsequent iteration(s). Therefore it may be seen that, in this step 104, a calculation process in iterations is implemented. Since the respective first complementary color brightness of each of the R, G, B, W sub-pixel units obtained in the third step 103 in each iteration may be obtained depending on the first complementary color ratio obtained in previous second step 102 in the same iteration, based on the desired brightness of W sub-pixel unit, such that the respective first complementary color brightness of each of the R, G, B, W sub-pixel units obtained in each iteration may converge by keep approaching continuously towards the desired brightness of W sub-pixel unit; correspondingly, the respective second chromaticity coordinate of each of the R, G, B, W sub-pixel units obtained in each iteration may become even more accurate by converging gradually (i.e., which may also function as the respective first chromaticity coordinate of each of the R, G, B, W sub-pixel units in the first step 101 of next iteration). Therefore, the more times the iterations are implemented, the result of the implementation of the last iteration may become more accurate. Correspondingly, then the first complementary color ratio among the R, G, B, W sub-pixel units obtained in the last iteration may be used as the second complementary color ratio among the R, G, B, W sub-pixel units. The second complementary color ratio among the R, G, B, W sub-pixel units may correspond to the desired brightness of W sub-pixel unit, and thus function as an accurate complementary color ratio corresponding to the desired brightness of W sub-pixel unit; and such second complementary color ratio among the R, G, B, W sub-pixel units then may be used as a practical complementary color ratio in subsequent practical operations of the WOLED display device for practical color complementation thereon.

Then it may be seen that, in above steps, the first complementary color ratio among the R, G, B, W sub-pixel units is essentially the complementary color ratio which is obtained in implementation of the previous (i.e., most recent) iteration and used in repeated iteration as an intermediate quantity only intending for calculation; while the second complementary color ratio among the R, G, B, W sub-pixel units is essentially a final result of above implementation of iteration(s) and functions as the complementary color ratio finally used in practice.

Step 105: implementing a color complementation step, i.e., implementing the color complementation of the WOLED display device depending on the second complementary color ratio among the R, G, B, W sub-pixel units, once the brightness outputted by the WOLED display device reaches the desired brightness of W sub-pixel unit.

In this step, the desired brightness of W sub-pixel unit and the second complementary color ratio among the R, G, B, W sub-pixel units corresponding to the desired brightness of W sub-pixel unit both obtained in above steps are applied in practical display process of the WOLED display device. To be specific, in a condition that once a threshold condition that the brightness outputted by the WOLED display device reaches the desired brightness of W sub-pixel is met, the desired brightness of W sub-pixel unit is multiplied by the second complementary color ratio among the R, G, B, W sub-pixel units so as to calculate the respective second complementary color brightness of each of the R, G, B, W sub-pixel units; and respective brightness practically outputted by the R, G, B, W sub-pixel units may in turn be adjusted to respective second complementary color brightness of each of the R, G, B, W sub-pixel units.

As seen from above embodiments, the WOLED display device is tested in practical use according to embodiments of the disclosure, and then calculations as above are implemented iteratively based on actual data measured in practice so as to obtain the accurate complementary color ratio corresponding to the desired brightness of W sub-pixel unit; and then the complementary color ratio calculated iteratively is applied practically to the operation of the WOLED display device so as to implement a real-time color complementation effect, and to obtain a more accurate color complementation effect as compared with a method for color complementation on a WOLED display device in relevant art, such that the accuracy in the color complementation on the WOLED display device may be enhanced effectively and the display effect may be improved accordingly.

Figure 2:
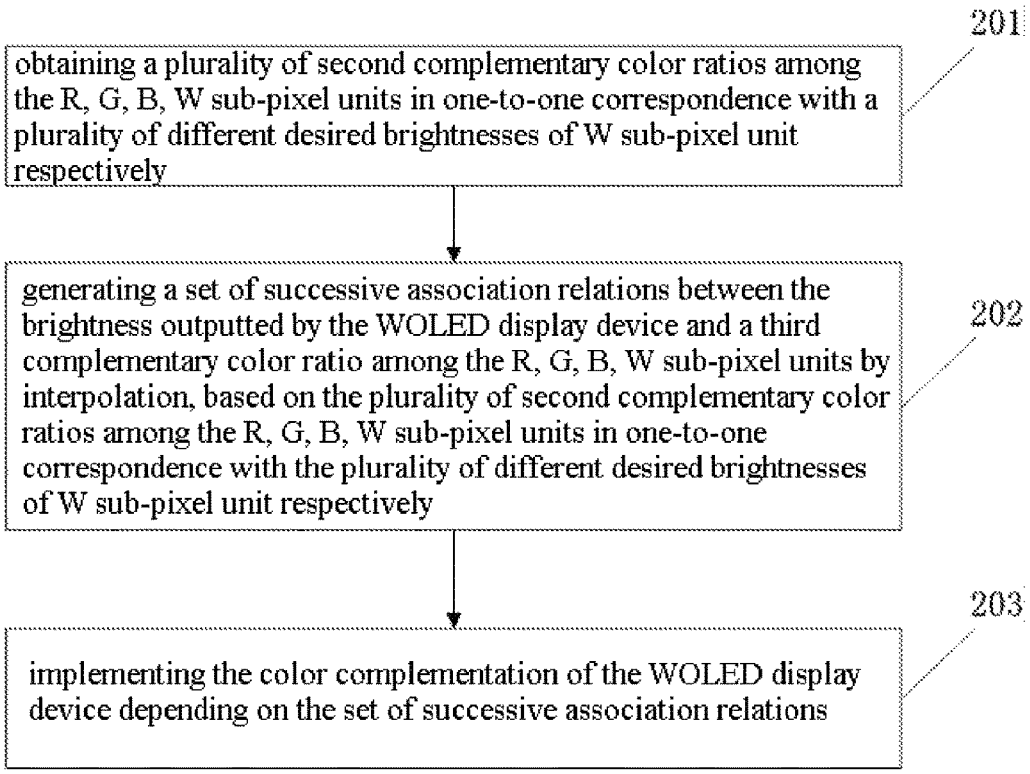
FIG. 2 illustrates a flow chart of steps in application concerning association relations between the brightness outputted by the WOLED display device and a third complementary color ratio among the R, G, B, W sub-pixel units according to an exemplary embodiment of the disclosure.

In an exemplary embodiment, after implementing above step 104, as illustrated in FIG. 2, the method for the color complementation on the WOLED display device further comprises applicable steps based on an association relation between the brightness outputted by the WOLED display device and a third complementary color ratio among the R, G, B, W sub-pixel units:

step 201: obtaining a plurality of second complementary color ratios among the R, G, B, W sub-pixel units in one-to-one correspondence with a plurality of different desired brightnesses of W sub-pixel unit respectively.

In this step, the plurality of different desired brightnesses of W sub-pixel unit are set; and by the steps 101 to 104 in above embodiments, the plurality of second complementary color ratios (among the R, G, B, W sub-pixel units) in one-to-one correspondence with the plurality of different desired brightnesses of W sub-pixel unit respectively may be obtained.

By way of example, when the plurality of different desired brightnesses of W sub-pixel unit are being selected, the plurality of different brightnesses of W sub-pixel unit may be continuously obtained at a predetermined interval (each interval is for example several times of a unit light intensity) to function as the plurality of desired brightnesses of W sub-pixel unit. And for example, a plurality of desired brightnesses of W sub-pixel unit at a same interval may be used for data selection conveniently and a sufficient accuracy may be provided in a subsequent interpolation calculation. It is apparent that the smaller interval is selected, the more accurate the association relation(s) may be obtained in the subsequent interpolation calculation but the heavier the processing workload for corresponding data setting and calculation is. Therefore, in consideration of the processing workload for the data setting and calculation, in present embodiment, the predetermined interval ranges between 1 nit and 10 nits, e.g., an exemplary value for the predetermined interval may be 5 nits.

In other embodiments, when the plurality of different desired brightnesses of W sub-pixel unit are in selection, different intervals may be used in selecting the plurality of different desired brightnesses of W sub-pixel unit, as per practical requirements of implementation.

Since in above selection of the plurality of different desired brightnesses of W sub-pixel unit, the plurality of different desired brightnesses of W sub-pixel unit may be obtained in a discrete manner; and based thereon, the process for calculating the second complementary color ratio may be implemented, which process is essentially a discrete color complementation process in practice, and thus may not realize an accurate color complementation for continuous change of the brightness in practical color complementation on a display. Therefore, it is taken into consideration that a set of successive association relations (for example, the third complementary color ratio below) which may change successively with a successive change in the desired brightness of W sub-pixel unit, among the plurality of different desired brightnesses of W sub-pixel unit, may be obtained, so as to implement a successive color complementation in real time, such that a more accurate color implementation effect may be realized. The specific steps thereof may be set forth hereinafter:

Step 202: generating a set of successive association relations between the brightness outputted by the WOLED display device and a third complementary color ratio among the R, G, B, W sub-pixel units by interpolation, based on the plurality of second complementary color ratios among the R, G, B, W sub-pixel units in one-to-one correspondence with the plurality of different desired brightnesses of W sub-pixel unit respectively.

In this step, the plurality of second complementary color ratios among the R, G, B, W sub-pixel units in one-to-one correspondence with the plurality of different desired brightnesses of W sub-pixel unit respectively are used, which are a set of discontiguous data, and then a set of successive association relations are generated by interpolation calculation. The set of successive association relations are essentially a set of association relations between the brightness outputted by the WOLED display device and the third complementary color ratio among the R, G, B, W sub-pixel units. And the third complementary color ratio among the R, G, B, W sub-pixel units is essentially a complementary color ratio obtained by calculation based on the set of successive association relations.

Step 203: implementing the color complementation of the WOLED display device depending on the set of successive association relations.

In this step, it is set forth in detail that the set of successive association relations are applied onto the practical display process of the WOLED display device. Specifically, depending on the association relations, the third complementary color ratio among the R, G, B, W sub-pixel units corresponding to the brightness outputted by the WOLED display device is determined, depending on the set of successive association relations, and respective third complementary color brightness of each of the R, G, B, W sub-pixel units is obtained by multiplying the brightness outputted by the WOLED display device by the third complementary color ratio among the R, G, B, W sub-pixel units; and respective brightness practically outputted by each of the R, G, B, W sub-pixel units is then adjusted to respective third complementary color brightness of each of the R, G, B, W sub-pixel units.

It may be seen from above exemplary embodiments that, by generating the association relations between the brightness outputted by the WOLED display device and the third complementary color ratio among the R, G, B, W sub-pixel units and applying such association relations onto the practical display processing of the WOLED display device, any brightness outputted by the WOLED display device may correspond to respective accurate complementary color ratio, so as to obtain an enhanced accuracy in color complementation and an improved display effect.

Based on the same inventive concept, in embodiments of the disclosure, it is further provided a display device which implements the method for the color complementation on the WOLED display device according to any exemplary embodiment a display panel comprising a plurality of pixels, each of which comprises a R sub-pixel unit, a G sub-pixel unit, a B sub-pixel unit, and a W sub-pixel unit; and a driving circuit, the driving circuit configured to obtain the second complementary color ratio among the R, G, B, W sub-pixel units in real time depending on the method for the color complementation as above and to adjust operative conditions of various pixels of the display panel so as to implement the color implementation on the WOLED display device, in a condition that the brightness outputted by the WOLED display device reaches the desired brightness of W sub-pixel unit.

Furthermore, when the display device applies above method for the color complementation on the WOLED display device according to the exemplary embodiments, the driving circuit is further configured to adjust the operative conditions of various pixels of the display panel so as to implement the color implementation on the WOLED display device depending on the association relation(s).

It is apparent that, since the method for the color complementation on the WOLED display device in above embodiments is applied, then the display device also possesses the technical effects of a high accuracy in the color complementation and a superior display effect.

As compared with relevant art, exemplary embodiments of the disclosure may provide some beneficial effects as below:

It may be seen from above that, as to the method for the color complementation on the WOLED display device and the display device as provided in embodiments herein, the WOLED display device is tested in practical use according to embodiments of the disclosure, and then calculations as above are implemented iteratively based on actual data measured in practice so as to obtain the accurate complementary color ratio corresponding to the desired brightness of W sub-pixel unit; and then the complementary color ratio calculated iteratively is applied practically to the operation of the WOLED display device so as to implement the color complementation effect, and to obtain a more accurate color complementation effect as compared with a method for color complementation on a WOLED display device in relevant art, such that the accuracy in the color complementation on the WOLED display device may be enhanced effectively and the display effect may be improved accordingly.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although the disclosure is described in view of the attached drawings, the embodiments disclosed in the drawings are only intended to illustrate the preferable embodiment of the present disclosure exemplarily, and should not be deemed as a restriction thereof.

Although several exemplary embodiments of the general concept of the present disclosure have been shown and described, it would be appreciated by those skilled in the art that various changes or modifications may be made in these embodiments without departing from the principles and spirit of the disclosure and lie within the scope of present application, which scope is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A method for color complementation on a white organic light emitting diode (WOLED) display device, comprising:

(a) acquiring respective first chromaticity coordinates of each of red (R), green (G), blue (B), and white (W) sub-pixel units for a brightness outputted by the WOLED display device;

(b) calculating a first complementary color ratio among the R, G, B, and W sub-pixel units depending on the respective first chromaticity coordinate of each of the R, G, B, and W sub-pixel units;

(c) determining a desired brightness of the W sub-pixel unit, and obtaining respective first complementary color brightnesses of each of the R, G, B, and W sub-pixel units by multiplying the desired brightness of the W sub-pixel unit by the first complementary color ratio among the R, G, B, and W sub-pixel units, and in turn determining respective second chromaticity coordinates of each of the R, G, B, and W sub-pixel units corresponding to the respective first complementary color brightnesses of each of the R, G, B, and W sub-pixel units; and (d) implementing in iterations steps (a), (b) and (c) at least once, so as to obtain a second complementary color ratio among the R, G, B, and W sub-pixel units corresponding to the desired brightness of the W sub-pixel unit;

wherein complementary color ratio is defined as a ratio among proportion values each of which is calculated by dividing respective desired brightness variations of each of the R, G, B, and W sub-pixel units to achieve the desired brightness of white light respectively, as a ratio among a respective desired variance ratio of brightness of each single sub-pixel unit in a pixel;

wherein during each iteration of steps (a), (b) and (c), the respective second chromaticity coordinate of each of the R, G, B, and W sub-pixel units acquired in a most recent iteration is used alternatively to function as the respective first chromaticity coordinate of each of the R, G, B, and W sub-pixel units in a current iteration, and the second complementary color ratio among the R, G, B, and W sub-pixel units is defined as the first complementary color ratio among the R, G, B, and W sub-pixel units acquired in the most recent iteration; and wherein the color complementation of the WOLED display device is carried out depending on the second complementary color ratio among the R, G, B, and W sub-pixel units when the brightness outputted by the WOLED display device reaches the desired brightness of W sub-pixel unit.

2. The method according to claim 1, wherein implementing the color complementation of the WOLED display device depending on the second complementary color ratio among the R, G, B, W sub-pixel units when the brightness outputted by the WOLED display device reaches the desired brightness of W sub-pixel unit comprises:

obtaining respective second complementary color brightnesses of each of the R, G, B, and W sub-pixel units by multiplying the desired brightness of the W sub-pixel unit by the second complementary color ratio among the R, G, B, and W sub-pixel units when the brightness outputted by the WOLED display device reaches the desired brightness of W sub-pixel unit; and adjusting respective brightnesses practically outputted by the R, G, B, and W sub-pixel units to respective second complementary color brightnesses of the R, G, B, W sub-pixel units.

3. The method according to claim 1, wherein following implementing in iterations steps (a), (b) and (c) at least once, so as to obtain the second complementary color ratio among the R, G, B, and W sub-pixel units corresponding to the desired brightness of W sub-pixel unit, the method further comprises:

obtaining a plurality of second complementary color ratios among the R, G, B, and W sub-pixel units in one-to-one correspondence with a plurality of different desired brightnesses of the W sub-pixel unit respectively;

generating a set of successive association relations between the brightness outputted by the WOLED display device and a third complementary color ratio among the R, G, B, and W sub-pixel units by interpolation, based on the plurality of second complementary color ratios among the R, G, B, W sub-pixel units in one-to-one correspondence with the plurality of different desired brightnesses of W sub-pixel unit respectively; and implementing the color complementation of the WOLED display device depending on the set of successive association relations.

4. The method according to claim 3, wherein implementing the color complementation of the WOLED display device depending on the set of successive association relations comprises:

determining the third complementary color ratio among the R, G, B, and W sub-pixel units corresponding to the brightness outputted by the WOLED display device, depending on the set of successive association relations, and obtaining respective third complementary color brightnesses of each of the R, G, B, and W sub-pixel units by multiplying the brightness outputted by the WOLED display device by the third complementary color ratio among the R, G, B, and W sub-pixel units; and adjusting respective brightnesses practically outputted by the R, G, B, and W sub-pixel units to respective third complementary color brightnesses of the R, G, B, and W sub-pixel units.

5. A display device which implements color complementation by applying the method according to claim 4, the display device comprising:

a display panel comprising a plurality of pixels, each of which comprises a red (R) sub-pixel unit, a green (G) sub-pixel unit, a blue (B) sub-pixel unit, and a white (W) sub-pixel unit; and a driving circuit, the driving circuit configured to implement color complementation of the WOLED display device depending on the second complementary color ratio among the R, G, B, and W sub-pixel units when the brightness outputted by the WOLED display device reaches the desired brightness of W sub-pixel unit.

6. The display device according to claim 5, wherein the driving circuit is further configured to implement the color complementation of the WOLED display device depending on the association relations.

7. The method according to claim 3, wherein obtaining a plurality of second complementary color ratios among the R, G, B, and W sub-pixel units in one-to-one correspondence with the plurality of different desired brightnesses of the W sub-pixel unit respectively comprises:

obtaining different desired brightnesses of the W sub-pixel unit at an interval to function as the plurality of desired brightnesses of W sub-pixel unit.

8. The method according to claim 7, wherein the interval ranges between 1 nit and 10 nits.

9. The method according to claim 8, wherein the interval is 5 nits.

10. A display device which implements color complementation by applying the method according to claim 7, the display device comprising:

a display panel comprising a plurality of pixels, each of which comprises a red (R) sub-pixel unit, a green (G) sub-pixel unit, a blue (B) sub-pixel unit, and a white (W) sub-pixel unit; and a driving circuit, the driving circuit configured to implement color complementation of the WOLED display device depending on the second complementary color ratio among the R, G, B, and W sub-pixel units when the brightness outputted by the WOLED display device reaches the desired brightness of W sub-pixel unit.

11. The display device according to claim 10, wherein the driving circuit is further configured to implement the color complementation of the WOLED display device depending on the association relations.

12. The method according to claim 3, wherein acquiring respective first chromaticity coordinates of each of R, G, B, and W sub-pixel units for the brightness outputted by the WOLED display device comprises:

increasing the brightness outputted by the WOLED display device persistently; and recording respective chromaticity coordinates of each of the R, G, B, and W sub-pixel units as the respective first chromaticity coordinates of each of the R, G, B, and W sub-pixel units, once the respective chromaticity coordinates of each of the R, G, B, and W sub-pixel units stops changing with increases in the brightness outputted by the WOLED display device.

13. A display device which implements color complementation by applying the method according to claim 12, the display device comprising:

a display panel comprising a plurality of pixels, each of which comprises a red (R) sub-pixel unit, a green (G) sub-pixel unit, a blue (B) sub-pixel unit, and a white (W) sub-pixel unit; and a driving circuit, the driving circuit configured to implement color complementation of the WOLED display device depending on the second complementary color ratio among the R, G, B, and W sub-pixel units when the brightness outputted by the WOLED display device reaches the desired brightness of W sub-pixel unit.

14. The display device according to claim 13, wherein the driving circuit is further configured to implement the color complementation of the WOLED display device depending on the association relations.

15. A display device which implements color complementation by applying the method according to claim 3, the display device comprising:

a display panel comprising a plurality of pixels, each of which comprises a red (R) sub-pixel unit, a green (G) sub-pixel unit, a blue (B) sub-pixel unit, and a white (W) sub-pixel unit; and a driving circuit, the driving circuit configured to implement color complementation of the WOLED display device depending on the second complementary color ratio among the R, G, B, and W sub-pixel units when the brightness outputted by the WOLED display device reaches the desired brightness of W sub-pixel unit.

16. The display device according to claim 15, wherein the driving circuit is further configured to implement color complementation of the WOLED display device depending on the association relations.

17. The method according to claim 1, wherein acquiring respective first chromaticity coordinates of each of R, G, B, and W sub-pixel units for the brightness outputted by the WOLED display device comprises:

increasing the brightness outputted by the WOLED display device persistently; and recording respective chromaticity coordinates of each of the R, G, B, and W sub-pixel units as the respective first chromaticity coordinates of each of the R, G, B, and W sub-pixel units, once the respective chromaticity coordinate of each of the R, G, B, and W sub-pixel units stops changing with increases in the brightness outputted by the WOLED display device.

18. A display device which implements color complementation by applying the method according to claim 1, the display device comprising:

a display panel comprising a plurality of pixels, each of which comprises a red (R) sub-pixel unit, a green (G) sub-pixel unit, a blue (B) sub-pixel unit, and a white (W) sub-pixel unit; and a driving circuit, the driving circuit configured to implement color complementation of the WOLED display device depending on the second complementary color ratio among the R, G, B, and W sub-pixel units when the brightness outputted by the WOLED display device reaches the desired brightness of W sub-pixel unit.

* * * * *